US005400563A

United States Patent [19]

House et al.

[11] Patent Number: 5,400,563

[45] Date of Patent: Mar. 28, 1995

[54] COMBINATION COLUMN AND PANEL BARRIER SYSTEM AND METHOD OF CONSTRUCTION

[75] Inventors: Randall H. House, San Antonio; Freddie C. Birck, Boerne; Johann H. Hofmann, San Antonio, all of Tex.

[73] Assignee: Marylyn House, San Antonio, Tex.

[21] Appl. No.: 249,692

[22] Filed: May 26, 1994

Related U.S. Application Data

[63] Continuation of Ser. No. 675,503, Mar. 26, 1991, abandoned.

[51] Int. Cl.[6] ..... E04B 2/10

[52] U.S. Cl. ..... 52/745.1; 52/747; 52/438; 52/606; 256/13.1; 256/19; 256/24

[58] Field of Search ..... 256/13.1, 19, 24, 25, 256/31, 73, 1; 52/437, 438, 609, 579, 574, 414, 442, 745.05, 745.09, 745.1, 745.13, 747, 606; 405/262, 284, 285, 286, 287; 404/6–8

[56] References Cited

U.S. PATENT DOCUMENTS

| | | | |
|---|---|---|---|
| 1,739,108 | 12/1929 | Weber | 405/262 |
| 1,933,483 | 10/1933 | Pennoyer | 61/39 |
| 1,943,800 | 1/1934 | Morrison | 61/39 |
| 2,129,369 | 9/1938 | Falser | 52/438 X |
| 2,963,827 | 12/1960 | Ganton | 50/370 |
| 3,678,815 | 7/1972 | Younker | 256/13.1 X |
| 3,732,653 | 5/1973 | Pickett | 52/71 |
| 3,832,817 | 9/1974 | Martens | 52/583 |
| 4,006,570 | 2/1977 | Stolz | 52/438 X |
| 4,019,293 | 4/1977 | Armas | 52/79 |
| 4,050,254 | 9/1977 | Meheen et al. | 61/39 |
| 4,111,401 | 9/1978 | Pickett | 256/13 |
| 4,193,584 | 3/1980 | Wieser | 256/19 |
| 4,214,411 | 7/1980 | Pickett | 52/144 |
| 4,336,675 | 6/1982 | Pereira | 52/437 X |
| 4,529,174 | 7/1985 | Pickett | 256/27 |
| 4,558,850 | 12/1985 | Melfi | 256/24 |
| 4,917,543 | 4/1990 | Cole et al. | 405/262 |
| 4,957,395 | 9/1990 | Nelson | 405/285 X |

FOREIGN PATENT DOCUMENTS

| | | | |
|---|---|---|---|
| 687605 | 8/1930 | France | 405/287 |
| 2071 | of 1907 | United Kingdom | 256/19 |

*Primary Examiner*—Randolph A. Reese
*Assistant Examiner*—Harry C. Kim
*Attorney, Agent, or Firm*—Gunn, Lee & Miller

[57] ABSTRACT

This invention relates to both concrete wall having a series of slanted deflection surfaces to spread the force of impacting vehicles, to buttress against earth forces, and to abate noises and to a method of constructing such a wall. The wall can be economically constructed from precast concrete elements which are adapted to be easily and rapidly stacked and joined in series to save on the cost of labor and materials. The wall is comprised of a series of panels which are stable and self-supporting when placed on a prepared foundation due to the Z-shape of the panels. Stable connection between the panels is provided by cast-in-place concrete, structural support columns. The legs of the Z-shaped panels form a stay-in-place form for the cast-in-place concrete when two Z-shaped panels are placed end to end. The cast-in-place concrete hardens and becomes integral structural support columns for the wall. Expansion joints between the wall and the foundation allow the wall to move without damaging the structural support columns.

9 Claims, 5 Drawing Sheets

COMBINATION COLUMN AND PANEL BARRIER SYSTEM AND METHOD OF CONSTRUCTION

This is a continuation of application Ser. No. 07/675,503, filed on Mar. 26, 1991, now abandoned.

BACKGROUND OF THE INVENTION

1. Field of the Invention

Applicant's invention relates to precast barrier systems and a method of construction. More specifically, the present invention relates to a precast concrete column and panel wall having a series of slanted deflection surfaces and a method of constructing such a wall on a foundation surface.

2. Background Information

In recent years, many civil engineering construction projects have used concrete barriers in numerous different applications; such as a retaining wall or as a barrier to keep out intruding people, animals, vehicles, fire, wind, light, sound, heat, and the like. For a concrete barrier to be selected for these different applications, the overall cost of the barrier must be low when considering the manufacturing costs, the manpower costs in construction and the time required to construct the wall. The barrier must also be durable and maintenance free with the possibility of a wide variety of aesthetically pleasing surface finishes. Cast-in-place concrete has given way to the use of precast concrete barriers. Precast concrete barriers are preferred because they can be manufactured at a lower cost with a higher degree of uniformity not found in cast-in-place concrete barriers. The precast concrete barriers may also be erected in numerous configurations and are capable of self support without massive construction.

Another cost which must be considered in many municipal areas is the availability and cost of purchasing right-of-ways for the construction projects. Consideration of the right-of-way requirements is particularly important in highway construction near residential areas. If the roadway is constructed near the residences, then the noise from passing vehicles and the impact of the noise on the nearby residences must be considered. Ideally the highway would be built far enough away from the residences so that the noise would not bother the residences.

However, due to the continued growth of urban sprawl and the need for more highways many times there just is not enough land available. In these situations, sound abatement walls are constructed to minimize the noise reaching the residence. Unfortunately, many of the current barrier designs require more right-of-way land than that which is available.

The need to reduce right-of-way requirements and the need to reduce costs has created a need for an environmental barrier system in which the width of barrier construction is small and which may be straight, curved, angled, or which may follow a terrain of any contour. The straighter and narrower the barrier construction, the lower overall construction costs since less land must be acquired.

Current free standing barrier designs typically use an undulating pattern to achieve the free standing structure. The barrier may use either a zigzag or other offset arrangement of panels that is self supporting. One off set type of barrier system is illustrated and described in U.S. Pat. No. 4,111,401, which was issued on Sep. 5, 1978 to William H. Pickett. An example of a structure having zigzag type of barrier system is illustrated and described in U.S. Pat. No. 3,732,653, which issued on May 15, 1973 to William H. Pickett. One problem with both of these designs is that they require a large amount of right-of-way land to allow room for the large width of barrier construction necessary for the barrier to be self supporting.

When freestanding undulating barriers are converted to straight line applications, column and panel arrangements have generally been found to be preferable to other barrier designs such as embedding panels. In a column and panel arrangement, a plurality of columns are spaced at predetermined distances from one another along the desired line for the barrier. When the columns arc set in position, panels made of metal, concrete, wood, plastic or the like are supported between adjacent columns to create the barrier structure.

Current column and panel barriers experience a variety of problems. One problem associated with these column and panel barriers is the need to very precisely position adjacent columns if prefabricated panels arc to be positioned in between. The positioning problem includes not only the column-to-column spacing but also the plumbness of the column both to the wall face and the panel edge. Once the panel dimensions are selected and the panels are fabricated, then the spacing between adjacent columns must correspond to the panel length for the full exposed length of the column. If precise column positioning is not maintained, then the panels will not fit between columns which are spaced too close or the panels cannot be attached to columns which are spaced too far apart.

In typical precast concrete construction, tolerances of plus or minus ¼ inch or more are common depending upon the fabricators' experience and the cost of forms. Accumulation of such tolerances require that positioning and placement of columns be very precise in order to accommodate the precast panels therebetween. Precise tolerances on the lateral spacing between columns can be very difficult to maintain at construction sites. Consequently, accumulation of tolerances can lead to a loose joint between panels and columns. With a loose joint, vibration can occur and sound, light, and other forces or energy can pass through the barrier. The present invention overcomes the problems with precise tolerances without any significant additional costs.

Another problem associated with column and panel barriers concerns thermally induced linear expansion and contraction of the completed barrier. Thermal variations in the wall can lead to loose joints during contraction as discussed above, structural damage of the columns and panels due to compressive stress developed during expansion, and construction difficulty when large thermal variations occur during construction. Thus, there is a need for a precast concrete barrier which overcomes problems of the types discussed above for column and panel barriers.

SUMMARY OF THE INVENTION

The present invention overcomes problems of the type discussed above by providing a precast concrete column and panel barrier having a series of slanted deflection surfaces to spread the force of impacting vehicles, to buttress against earth forces, to abate noises, and to a method of constructing such a barrier. The barrier can be economically constructed from precast concrete panels which are adapted to be easily and rapidly stacked and joined in series to save on the cost of labor and materials. The barrier is comprised of a series of panels which are stable and self-supporting when placed on a prepared foundation due to the z-shape of the panels. Stable connection between the panels is provided by cast-in-place concrete, structural support columns. The legs of the z-shaped panels form a stay-in-place form for the cast-in-place concrete when two z-shaped panels are placed end to end. The cast-in-place concrete hardens and becomes integral structural support columns for the wall. Expansion joints between the wall and the foundation allow the wall to move without damaging the structural support columns.

It is an object of the present invention to provide an efficient method of constructing a barrier without the need for separate structural support columns.

Another object of the present invention is to provide a barrier which can withstand thermal variations without damaging the structural integrity of the barrier.

A further object of the present invention is to provide a means for constructing the barrier at any angle from 0 degrees to 360 degrees.

Still a further object of the present invention is to provide a barrier which can be constructed at reduced labor, material, and right-of-way costs.

Additional advantages, objects and uses will be apparent from the description to those familiar with relevant art.

The foregoing objectives are achieved in a precast barrier in accordance with the present invention.

DETAILED DESCRIPTION OF THE PREFERRED EMBODIMENT

Figure 1:
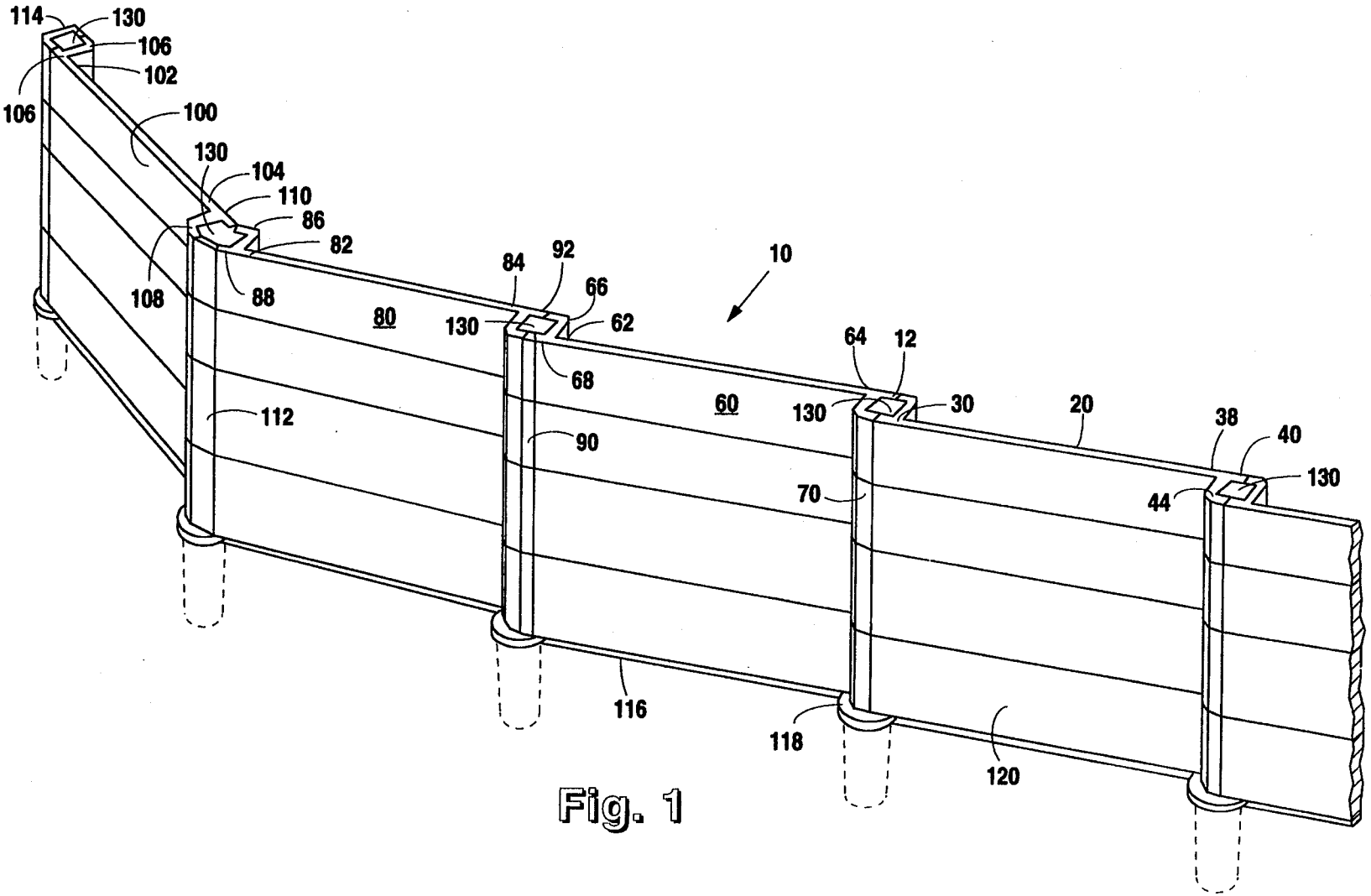
FIG. 1 is a perspective view of a barrier system comprising a column and panel wall constructed in accordance with one embodiment of the present invention.

The preferred embodiment of the present invention is illustrated in FIG. 1. The barrier 10 may be used in numerous situations where it is desirous to keep two areas separated, such as an attractive earth retaining wall or traffic barrier for roadways. It may also be used as a sound abatement wall, a security wall, a sea wall, or a free-standing temporary wall. The height-of barrier 10 may be varied to meet the specific requirements of its intended use by stacking individual panels. The barrier may be constructed out of any formable material such as fiberglass, plastic, steel, galvanized iron, reformed shredded plastic, concrete, or other materials having suitable hardness and durability properties.

In the preferred embodiment, barrier 10 is comprised of a plurality of precast, reinforced concrete panels 20 and a plurality of cast-in-place, reinforced concrete columns 130. The barrier may be constructed in a straight line or in a curve to meet the specific geographic requirements of the location as illustrated in FIG. 1.

Figure 2:
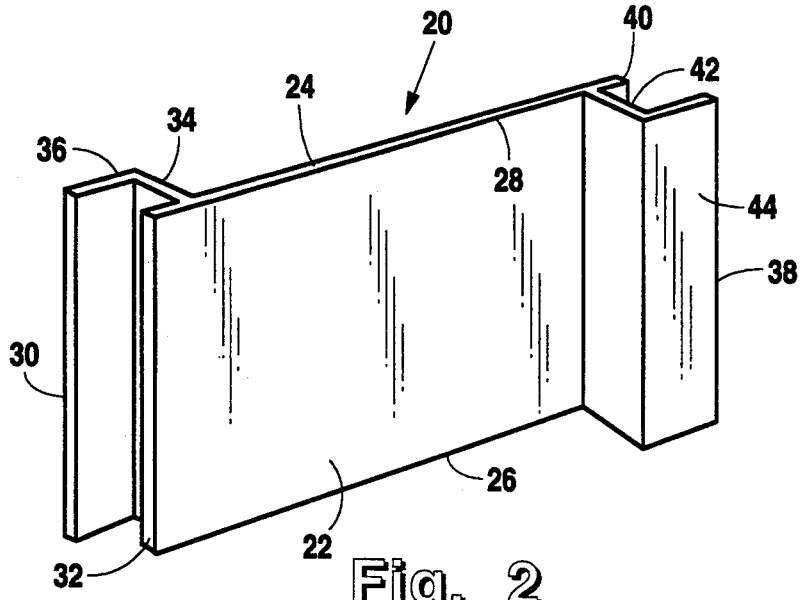
FIG. 2 is a perspective view of a panel in the column and panel wall of FIG. 1.
Figure 3:
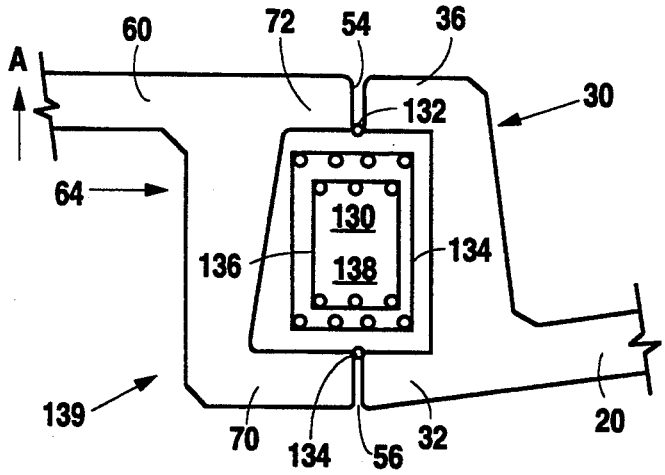
FIG. 3 is a top plan view of a column for a relatively small degree of angle of curvature of the wall in the column and panel wall of FIG. 1.
Figure 4:
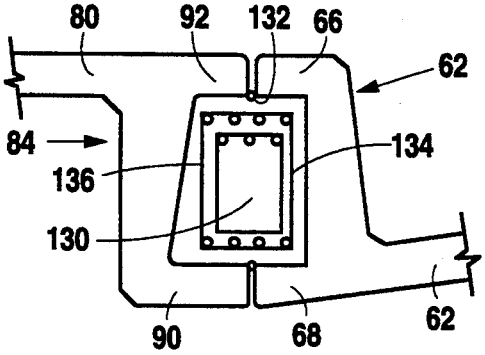
FIG. 4 is a top plan view of a column for a small degree of angle of curvature of the wall in the column and panel wall of FIG. 1.
Figure 5:
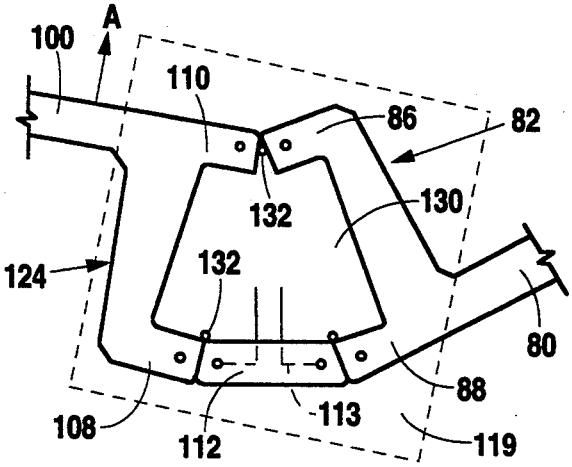
FIG. 5 is a top plan view of a column for a large degree of angle of curvature of the wall in the column and panel wall of FIG. 1.

As shown in FIG. 2, each panel has parallel faces 22, 24, a bottom horizontal surface 26, an upper horizontal surface 28, and vertically extending edge surfaces 30, 38. Bottom horizontal surface 26 is adapted for direct contact with either the ground, foundation, or a stacked panel. Edge surfaces 30, 38 are surfaces of U-shaped configuration having a pair of legs 32, 36 and 40, 44, respectively, and a base 34, 42, respectively. If barrier 10 is to be in a straight line, then the U-shaped surfaces are precast with the legs having the same length. If barrier 10 requires a curvature, then U-shaped edge surfaces 30, 38 may be precast with the legs having different lengths as shown in FIG. 4. Some curvature is possible in barrier 10 during construction by placement adjustments or by adding inserts 112 as illustrated in FIGS. 3 and 5, respectively.

Panel 20 may be designed to meet the specific load requirements of its use. The amount and strength of the embedded grid of vertical and horizontal reinforcement bars (not shown) may be varied. The thickness of panel 20 may also be varied to meet specific requirements. If panel 20 is to be used as a traffic barrier or in the bottom row of stacked panels then the barrier may be precast with a thickness of four inches to one hundred twenty-four inches, although in the preferred embodiment it will be seven inches thick with three quarters of an inch of exposed aggregate or other required surface material on each face 22, 24. The typical panel will have a thickness of two inches to one hundred twenty-two inches, although in the preferred embodiment it will be five inches thick with three quarters of an inch of exposed aggregate or other required surface material on each face 22, 24. The thickness of panel 20 has no upper limit as edge surfaces 30, 38 would also expand and, thus, the panel would still be stable and self-supporting. Panel 20 is also easily transportable over existing roadways and railways.

The panel is stable and self-supporting due to edge surfaces 30, 38. When viewed from above as in FIGS. I and 8, the panel 20 has a Z-shaped configuration. The Z-shape of panel 20 allows easier and quicker construction of a barrier 10 because the contractor can stand upright a plurality of panels onsite in preparation for placement in barrier 10. The panels will then be easily and quickly moved into place and stacked upon one another. The faster construction process allows the contractor to save on the cost of labor and materials. An inventive aspect of the preferred embodiment is that panel 20 is capable of being a free standing structure that relies on no other means of support other than that derived from its own stability.

The construction time is also reduced because edge surfaces 30, 38 are adapted to create a stay-in-place form for column 130 when placed adjacent to the edge surfaces of an adjoining panel. Cast-in-place concrete is then poured into the stay-in-place form creating the column 130 which ensures proper alignment with panel 20. This is another inventive aspect of the preferred embodiment as panel 20 is a free standing structure so shaped so that when two panels are placed adjacent to each other they form a stay-in-place form for a column that requires no additional forming other than that incorporated into the panels. Cast-in-place concrete is then poured into the stay-in-place form creating the column 130 which ensures proper alignment with panel 20. This invention eliminates the common problem found in current column and panel walls. Current walls have imprecise lateral placement of panels due to accumulated variances in the panels and placement of the columns. Much construction time is wasted as contractors have to modify or add material to the panels or columns to obtain proper placement. If the placement is bad enough, then the columns may have to be re-built.

Turning to FIG. 3, column 130 is a structural support column for the barrier comprised of cast-in-place concrete 138, stay-in-place form 139, and rebar or reinforcing steel cages or mats. The amount and strength of the reinforcing steel 134 may be varied to meet the specific design requirements of the particular job. Stay-in-place form 139 consists of two or more sections which when joined in a juxtaposed position becomes a form for the cast-in-place concrete. Stay-in-place form 139 not only creates the form for the cast-in-place concrete it also fulfills structural and architectural requirements at the same time. The stay-in-place form bears and transfers some of the forces and stresses applied to the barrier. The exterior of the stay-in-place form may have exposed aggregate or other architecturally pleasing surface material.

In the preferred embodiment, stay-in-place form 139 consists of U-shaped edges 30, 64. Each edge is one-half of stay-in-place form 139 for column 130. The U-shaped edge 30 of panel 20 is adapted to be located adjacent to the corresponding U-shaped edge 64 of adjacent panel 60. Chamfers 132, 134 may be placed in gaps 54, 56 to prevent the cast-in-place concrete from leaking out of stay-in-place form 139 during the pouring and hardening process.

To construct column 130, U-shaped edges 30, 64 are placed adjacent to each other and are supported by support 118 (see FIG. 1). Reinforcing steel 134 extends from support 118 into stay-in-place form 139 created by U-shaped edges 30, 64 (see FIG. 7). The amount and strength of the reinforcing steel may be varied to meet design specifications. The length of the steel can also be varied to interconnect the support for barrier 10 from one row of panels to another row of panels. In a single row of panels, reinforcing steel 134 will extend only into the bottom row of panels.

To support column 130 in its vertically upstanding position, any one of a multitude of suitable conventional supports may be used which would allow a round cage to extend from the support through the column. It is expected that either a drill shaft, a drill pier, cast-in-place spread footing, a caisson, or a steel piling encased in concrete may be used. If the ground underneath column 130 is hard and stable, then a ground anchor could even be used.

If two rows of panels are used in the barrier, then reinforcing steel 134 may extend into both the bottom row of panels and second row of panels. In some situations reinforcing steel 134 may extend only into the bottom row of panels and reinforcing steel 136 extends from the bottom row of panels into the second. If more rows of panels are stacked, then the reinforcing steel is spliced into the lower levels to obtain the required strength and support for barrier 10.

After U-shaped edges 30, 64 are aligned with support 118, cast-in-place concrete 138 is poured into stay-in-place form 139 and is allowed to harden. Upon hardening, column 130 becomes a structural support for barrier 10 integrated with panels 20, 60. The reinforcing steel encased in cast-in-place concrete 138 of column 130 assists the structural column to withstand overturning and destructive forces.

If panels 20, 60 are to be used as part of a temporary barrier, then column 130 may be eliminated, including reinforcing steel 134, 136 and cast-in-place concrete 138. This allows the panels to be easily removed after the need for the temporary barrier passes. Since panels 20, 60 are Z-shaped they are free standing and are sufficiently stable and self-supporting to provide the desired barrier qualities without column 130.

In certain situations, the barrier will be constructed where it must follow the curve of the roadway or embankment being reinforced. FIG. 1 illustrates barrier 10 being used as a retaining wall in a straight line which gently curves in a clockwise direction. Barrier 10 could be built to curve counter-clockwise or any other non-straight line to meet the design specifications of each particular job.

FIG. 3 illustrates construction of the barrier if the desired angle of curve is relatively small, about 1° or less. Normally, gaps 54, 56 are the same, about three-quarters of an inch. When a relatively small degree of curve is required, the legs of panels 20 and 60 are placed adjacent to each other so that the gap between one set of legs is less than the other set of legs, depending on the direction of curvature. For a clockwise curve A, gap 54 is less than gap 56. This will result in a curvature of about 1° to the right when barrier 10 is viewed from above. Chamfers 132 are placed in gaps 54, 56 to prevent cast-in-place concrete 138 from leaking out of stay-in-place form 139 prior to hardening.

FIG. 4 illustrates construction of the barrier if the desired angle of curve is small, between about 1° and 10°. To obtain a small angle of curve, U-shaped edges 62 and 84 of panels 60 and 80 are precast with different length legs. The legs may have an interior length which varies from 1 inch to 100 inches and an exterior length which varies from 2 inches to 120 inches. In the preferred embodiment, the legs are 7½ inches long for the interior length and an exterior length which slopes from 13 inches to fourteen and three-eight inches. To achieve a clockwise small angle of curve A, leg 90 of panel 80 is precast longer than leg 92. Depending on the required angle, legs 90, 92 may vary as much as 24 inches in length. In the preferred embodiment, leg 90 will be about 3 inches longer than leg 92 to obtain a 10° angle of curve. Panel 60 has legs 66, 68 which are of the same length. If a counter-clockwise angle of curve is desired then leg 66 would be precast longer than leg 68 and legs 90, 92 would be precast the same length.

FIG. 5 illustrates construction of the barrier if the desired angle of curve is large, greater than about 10°. In this situation, legs 86, 88 of panel 80 and legs 108, 110 of panel 100 are all of the same length. Precast spacer 112 with tieback rods 113 is inserted between legs 88 and 108. The tie back rods keep spacer 112 in place while the cast-in-place concrete hardens. Another embodiment of the present invention uses a wedge shaped spacer 112 which has its wider face on the interior of the stay-in-place form. The adjoining legs are cast to complement the wedge design. Therefore, the pressure of the cast-in-place concrete actually presses the spacer against the adjoining legs ensuring that the spacer remains in place while the cast-in-place concrete hardens.

The length of spacer 112 can vary from 1 inch to 100 inches depending upon the required amount of clockwise curvature A. Curvature A can be as great as 90° with spacer 112, if larger degrees of curvature is desired then spacer 112 could be modified and be precast in a curve. If a counter-clockwise curve is desired, then spacer 112 would be placed between legs 86 and 110. Due to the larger column 130, support 118 could be expanded to properly support the column with spread footing 119.

FIGS. 3, 4, and 5 illustrate the independent use of varied gaps, varied length of legs, and a spacer. In actual use, all three methods could be used in any combination, or all at once, to meet the specific requirements of the job.

Figure 6:
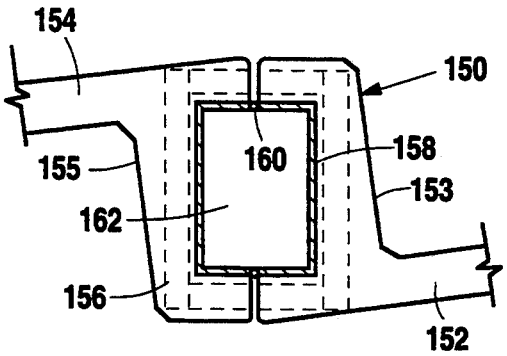
FIG. 6 is a top plan view of an expansion joint column for a column and panel wall of FIG. 1.

Thermally induced expansion and contraction of panel 20 may lead to cracking of the panel in barrier 10 unless some arrangement is established to relieve thermally induced expansions and contractions. Cracking can also be created by external forces applied to the barrier, such as wind forces, impact forces from vehicles, lifting or sinking forces from ground swell or collapse, and the like. The present invention uses an expansion joint column as illustrated in FIG. 6 as one method of relieving the thermally induced internal forces and external forces.

Expansion joint column 150 is formed by panel 152 being placed adjacent to panel 154. U-shaped edges 153 and 155 are placed over support 118 (not shown) and create the stay-in-place form for expansion joint 150. Sufficient reinforcing steel (not shown) is inserted in the stay-in-place form to meet the design specifications. Cushioning material 156 is placed between U-shaped edges 153, 155 and the support. Padding material 158 is placed on the inside of the stay-in-place form created by U-shaped edges 153, 155. Any material with sufficient padding and cushioning properties could be used as material 156, 158. However, in the preferred embodiment neoprene is used as cushioning material 156 and fiberboard is used as padding material 158. Chamfers 160 are placed between U-shaped edges 153, 155. Depending on the expected internal and external forces expansion joint column 150 could be used in place of column 130. In most situations, expansion joint column will be used approximately every 100 feet of the barrier 10 to provide for sufficient expansion and contraction of the barrier without cracking.

When barrier 10 terminates, closure piece 114 is used to finish barrier 10 in an aesthetically pleasing look. Closure piece 114 is U-shaped and is adapted to be placed adjacent to the U-shaped edge of the adjoining panel. The closure piece 114 and adjoining U-shaped edge create the stay-in-place form for column 130. Reinforcing bar extends from within closure piece 114 into the column 130 keeping closure piece 114 in its proper location once the cast-in-place concrete hardens. Sufficient reinforcing steel to meet the design specifications is also inserted in column 130 when the column is located at the end of barrier 10.

Figure 7:
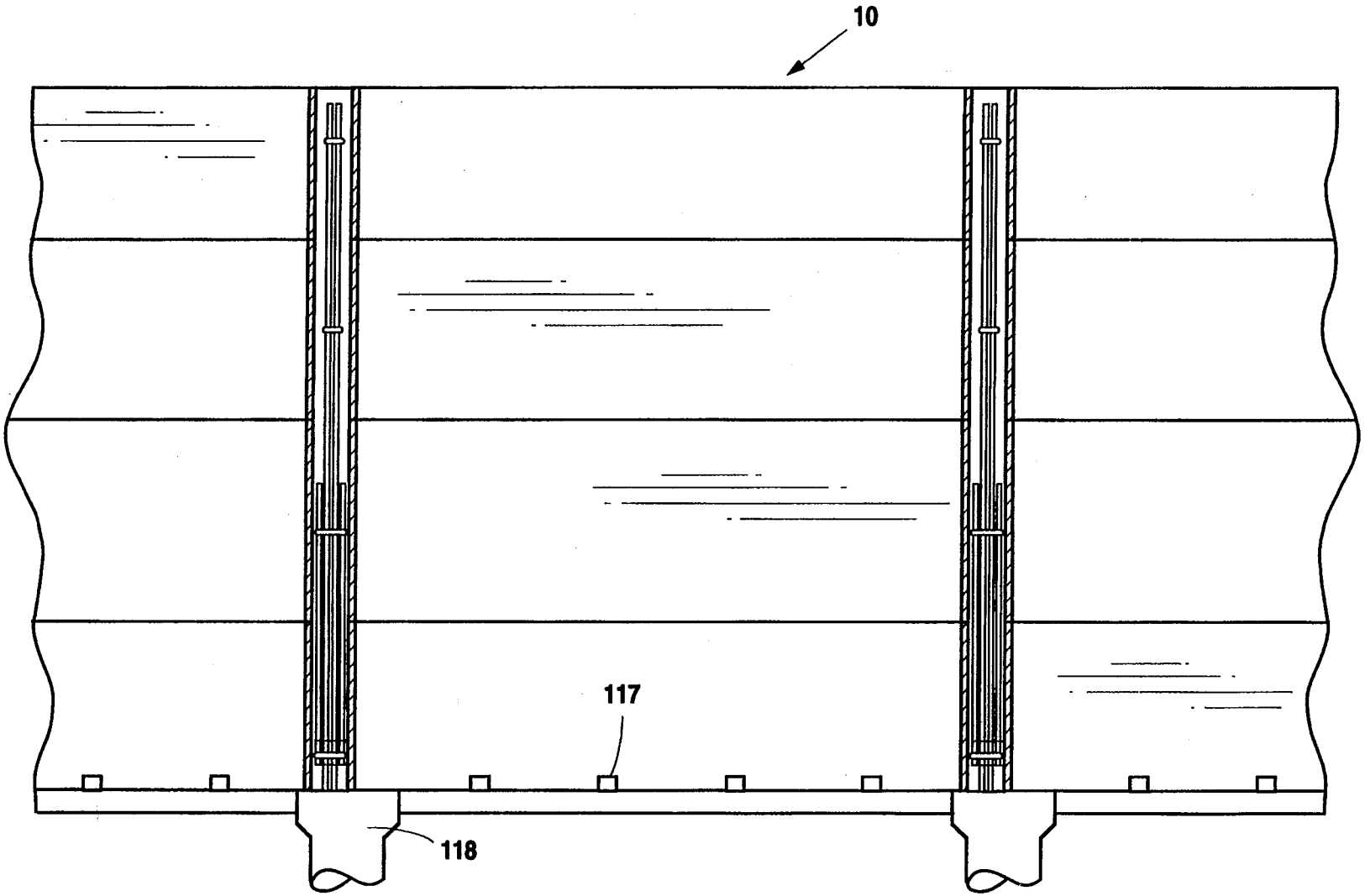
FIG. 7 is a cross-sectional view of a portion of a column and panel wall of the wall of FIG. 2.

If the design requirements for the location of barrier 10 require fluid flow from one side of the panel to the other side, then drains 117 may be added as illustrated in FIG. 7. Drains 117 are precast in the panels. The amount of expected fluid flow will determine the number and size of drains 117.

Barrier 10 rests on, and is supported by, foundation 116 and support 118. Foundation 116 is built prior to the placement of the panels. The foundation can be made of any material having the necessary stability, strength, and durability properties including, but not limited to, concrete, crushed limestone, pea gravel, and the like. In some locations, the ground may be flat, stable, and solid enough so that the panel may rest directly on the ground. When resting directly on the ground, the reinforcing steel for the columns could driven into the ground or be anchored by ground anchors including, but limited to, Dywidag anchors and the like.

Figure 8:
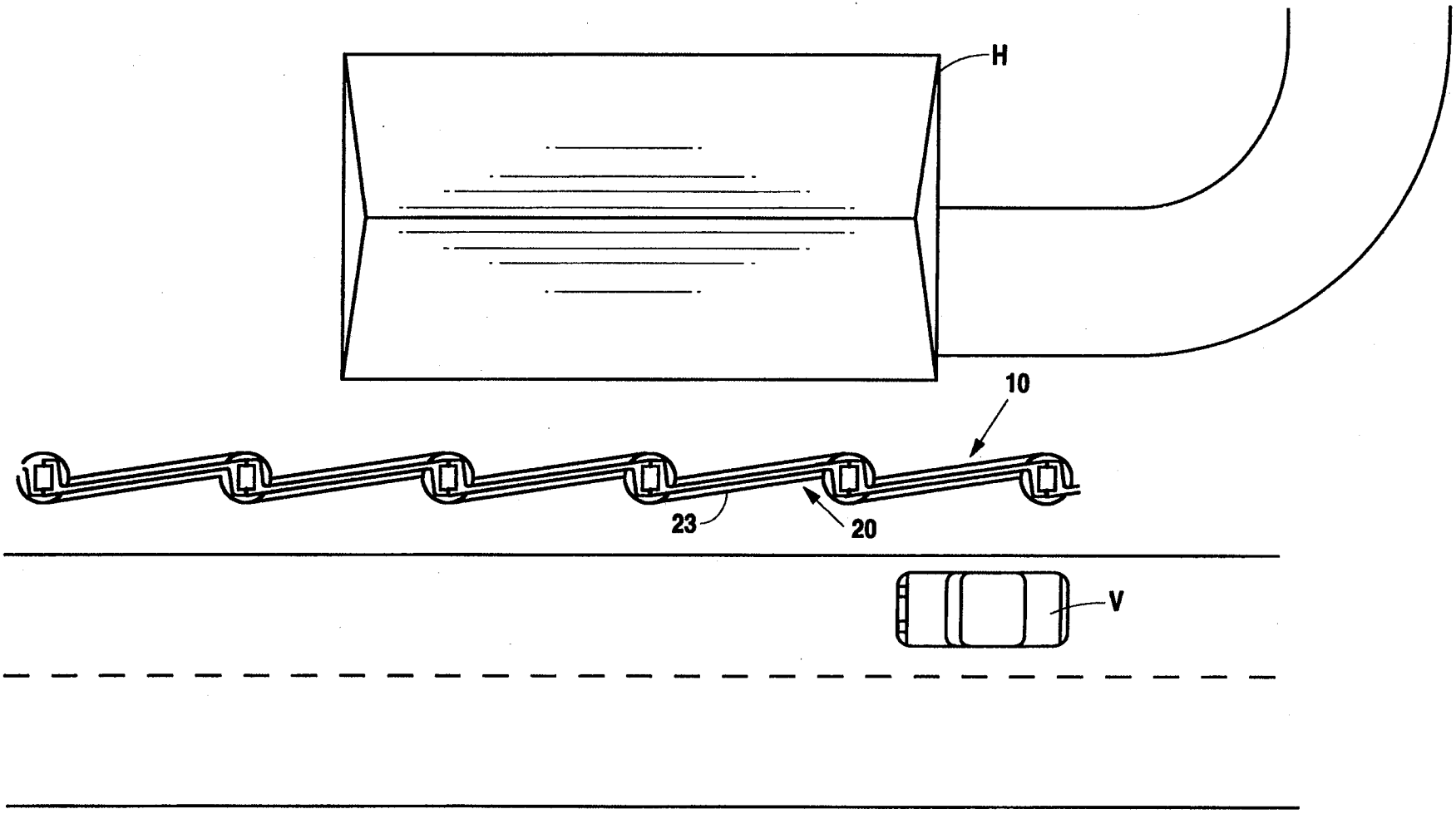
FIG. 8 is a top plan view of a sound abatement wall constructed in accordance with the present invention.

Another use of the barrier of the preferred embodiment is as a sound abatement wall as illustrated in FIG. 8. With diminishing land for highway right-of-ways, the present invention provides a sound abatement wall which requires only a very small amount of right-of-way to effectively reduce the noise reaching the nearby homes H. The slanted faces of the panels are generally parallel to each other as the barrier follows the direction of the right-of-way. The stackable panels of barrier 10 allows the sound abatement wall to be built to a sufficient height to extend above the line of sight between the homes H and the sound source, here exhaust noise and other engine noises from passing vehicles V. The noise is both absorbed by the wall and deflected by the slanted face 22 (FIG. 2) of panel 20 thereby reducing the amount of noise reaching homes H. It has been found that the most effective height for barrier 10 for acoustical design purposes is the perpendicular distance from the line of sight between home H and vehicle V. The sound abatement wall may vary in height from 4 feet to over 100 feet, however it has been found that a 20 feet tall wall sufficiently reduces the noise from passing vehicles.

Since a possibility exists for vehicle V to swerve and hit barrier 10, the bottom row of panels are sufficiently reinforced by increased concrete thickness and reinforcing steel to withstand the impact. The slanted face of panel 20 also serves as a deflection surface 23 to reduce the impacting force of a vehicle V striking barrier 10. If vehicle V strikes the barrier 10, the vehicle will be deflected by deflection surface 23 back onto the roadway thereby, also, minimizing injury sustained by any occupants of the vehicle.

If the situation warrants additional protection from impacting vehicles, the sound abatement wall may be constructed in conjunction with a sloped face safety barrier of the Jersey barrier type to further assist in deflecting an impacting vehicle away from barrier 10.

The barrier may also be used as a removable barrier. Since the panels are stable and self-supporting the barrier can be constructed without the use of cast-in-place concrete columns. The columns could be left empty or filled with sand or other removable material. There are several situations where a freestanding barrier is preferred. For example, when a dignitary or head of state visits different cities, security measures must be increased for that person's safety. The freestanding barrier of the present invention would be ideal.

Another possible use of the freestanding barrier is in situations where temporary protection is required from a source of dangerous materials or energy, such as nuclear radiation. When work on a nuclear power plant requires dismantling of parts of the system, there is a possibility that trace amounts of radiation would be released. To provide for reduced radiation release to the environment and to protect the workers and other personnel, the freestanding barrier of the present invention could be used. A flat concrete floor of the power plant would provide the necessary foundation and support for the barrier without any additional supports or foundation. Once the work is completed, the barrier could be removed to allow normal use and operation of the power plant.

Figure 10:
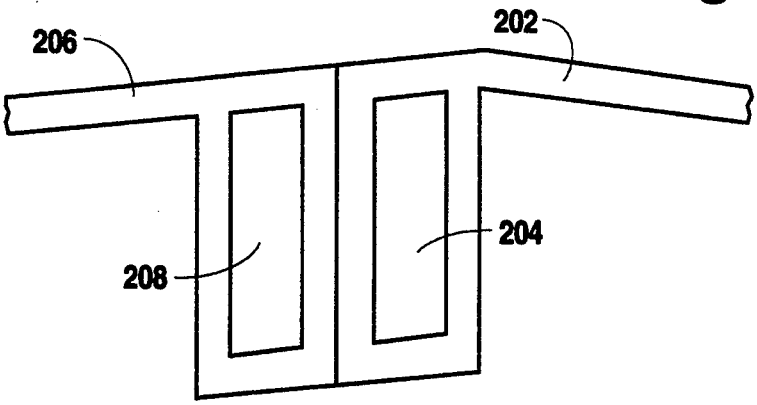
FIG. 10 is a top plan view of an alternate column for the invention in FIG. 9.
Figure 9:
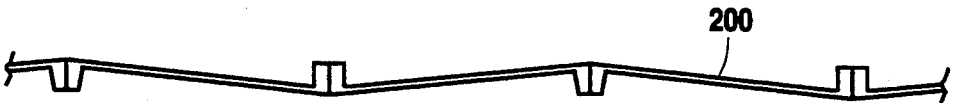
FIG. 9 is a top plan view of an alternate embodiment of the present invention.

An alternate embodiment of the present invention is disclosed in FIGS. 9 and 10. In this alternate embodiment the barrier 200 is constructed of panels with slanted deflection surfaces. The change is that the adjacent panels 202, 206 have edges 204, 208 which are adjacent to each other on alternating sides of the barrier 200. The edges are adjacent first on one side of the barrier and then on the other side of the barrier. Instead of having U-shaped edges, the alternate embodiment uses box edges 204, 208. The box edges are hollow allowing the use of reinforcing rods and cast-in-place concrete, as described above for the preferred embodiment, to provide a structural support column which is integral with the barrier.

Construction of the barrier 10 starts with detailed analysis of the site and any special design requirements of the barrier. The panels are precast to meet the design requirements such as: drains; extra reinforcement of the bottom panel if the potential for vehicle impacts exists; conduits in the panels for running electrical cables for lights or other applications; and precasting the panels to meet the curvature requirements of the location. The panels are then easily transported over existing highways and railways to the site location and placed in the vicinity of their final placement in the barrier.

Any one of a multitude of suitable conventional foundations and supports may be used to support the panels and columns. For example, drill piers may be used to support the columns and a concrete base may be used to support the panels. The specific support and foundation for the barrier is determined by the job site subsurface soil conditions and the use of the barrier. Factors which should be considered in determining the specific foundation include, but are not limited to, thermal expansion, thermal contraction, broadside force, longitudinal force, weight from the barrier, frost heave, impact force, wind force, ground elevation, and soil stability.

A graded concrete foundation is constructed in the direction of the barrier. If a stable surface exists, the foundation could be just the ground. Drill piers shafts are drilled at about 20 feet intervals. The depth of the drill piers shaft may vary depending on analysis of the above factors. Reinforcing bars extends from the drill pier shaft upwards an appropriate length to meet the design requirements. If leveling of the area around the drill shaft is required, a cast riprap leveling pad may be poured around the drill shaft.

The bottom row of panels are set on top of the foundation and supports with the reinforcing steel extending into the form created by the adjacent U-shaped edges of the panels. Shims may be used to assure that the first row of panels is level and plumb. After the bottom panel row is erected, cast-in-place concrete is poured into the forms encasing the reinforcing steel. If conditions allow, two panels may be stacked on top of one another before pouring the cast-in-place concrete.

After the cast-in-place concrete has reached its required strength, the preceding steps would be repeated to the required height of the barrier. Spliced vertical reinforcing bars may be inserted in the form as required for taller barriers. This splicing shall be completed before setting of the upper panels.

The barrier may be constructed to any engineered height, however, in most uses the wall may vary from 6 feet tall to 26 feet tall. The individual panels are expected to be 6 feet tall and 4 feet tall to allow various combinations to reach the required height.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A method of constructing a precast concrete wall at a job site having a right of way, said wall consisting of a plurality of precast concrete, combination panel and column modules, wherein a first precast module and a second precast module each are comprised of: a generally vertically disposed panel having a thickness, a height, and a first generally vertical edge and a second generally vertical edge; a first generally vertically disposed U-shaped member and a second generally vertically disposed U-shaped member, each said first and said second U-shaped member having a front leg and a rear leg, and a thickness and a height substantially similar to said thickness and said height of said panel, each said first and said second U-shaped members horizontally located at opposite ends of said panel; each said panel of said first precast module and said second precast module slanting in a horizontal plane from said front leg of said first U-shaped member to said rear leg of said second U-shaped member; said first U-shaped member, said second U-shaped member, and said panel capable of overcoming ambient overturning forces exerted on said panel whereby each said precast module is inherently stable and capable of standing upright with no other support, wherein said method of construction comprises the steps of:

a. constructing foundation means in the direction of said wall for supporting said wall, said foundation means having; reinforcing material through said foundation means, said reinforcing material extending upwards a sufficient height for reinforcing said wall;

b. transporting said first and said second precast modules to said job site and placing said first and said second precast modules in the vicinity of their final placement in said wall;

c. positioning said first precast module over said foundation means so that said first precast module is aligned with a top surface of said foundation means;

d. lowering said first precast module so that said first precast module engages said top surface of said foundation means by lengthwise contact thereagainst in a stacked relationship, a bottom surface of said vertically disposed panel of said first precast module and said first and said second U-shaped members of said first precast module support said first precast modules' weight in an upright position overcoming ambient overturning forces;

l. placing said second precast module adjacent to said first precast module so that said second U-shaped member of said second precast module is removably coupled with said first U-shaped member of said first precast module forming a stay-in-place form surrounding said reinforcing material extending upward from said foundation means;

f. pouring cast-in-place concrete into said stay-in-place form encasing said reinforcing material; and g. allowing said cast-in-place concrete to harden so that said stay-in-place form becomes an integral part of said first and said second precast module.

2. The method of construction as claimed in claim 1 further comprising the step of placing a first plurality of said first and said second precast modules along said right of way to form a first row of said first and said second precast modules prior to pouring said cast-in-place concrete in said stay-in-place form.

3. The method of construction as claimed in claim 2 further comprising the step of placing a second plurality of said first and said second precast modules forming a second row of said first and said second precast modules on top of said first row of said first and said second precast modules after pouring said cast-in-place concrete in said stay-in-place form.

4. The method of construction as claimed in claim 1 further comprising the steps of:

a. pouring said cast-in-place concrete to construct said foundation means; and b. allowing said cast-in-place concrete of said foundation means to harden to a design strength capable of supporting said first and said second precast modules prior to positioning said first precast module over said foundation means.

5. The method of construction as claimed in claim 1 further comprising the step of attaching a cage of reinforcing material to said reinforcing material extending upward from said foundation means prior to positioning said first precast module over said foundation means.

6. The method of construction as claimed in claim 1 further comprising the steps of:

a. placing said first and said second precast modules adjacent to each other with a slight gap between said second U-shaped member of said first precast module adjacent said first U-shaped member of said second precast module;

b. placing a chamfer in said gap to keep said cast-in-place concrete from leaking out of said stay-in-place form while said cast-in-place concrete is being poured and is hardening to design strength.

7. The method of construction as claimed in claim 1 further comprising the steps of:

a. drilling a plurality of drill pier shafts to a sufficient depth for withstanding expected overturning and destructive forces which may be applied to said wall, said drill pier shafts substantially aligned with adjacent drill pier shafts having a distance separating said drill pier shafts which is substantially the same distance as said length of said first and said second precast modules;

b. placing reinforcing material into said drill pier shafts and extending upwards a sufficient height for reinforcing said wall; and c. pouring cast-in-place concrete into said drill pier shafts and encasing said reinforcing material prior to positioning said first precast module over said foundations means.

8. The method of construction as claimed in claim 1 further comprising the step of preparing an expansion joint stay-in-place form in said wall.

9. The method of construction as claimed in claim 8 further comprising the steps of:

a. placing cushioning between said stay-in-place form and said foundation means; and a. attaching padding material to the inside of said stay-in-place form.

* * * * *